US005897397A

United States Patent [19]

Yokozawa

[11] Patent Number: 5,897,397

[45] Date of Patent: Apr. 27, 1999

[54] CONNECTOR PLUG FOR AUTOMOBILES

[75] Inventor: Hiroshi Yokozawa, Tokyo, Japan

[73] Assignee: SMK Co., Ltd., Tokyo, Japan

[21] Appl. No.: 08/817,395

[22] PCT Filed: Jul. 10, 1996

[86] PCT No.: PCT/JP96/01911

§ 371 Date: Apr. 16, 1997

§ 102(e) Date: Apr. 19, 1997

[87] PCT Pub. No.: WO97/07570

PCT Pub. Date: Feb. 27, 1997

[30] Foreign Application Priority Data

Aug. 18, 1995 [JP] Japan ..... 7-233354
Aug. 18, 1995 [JP] Japan ..... 7-233356

[51] Int. Cl.[6] ..... H01R 13/00

[52] U.S. Cl. ..... 439/668

[58] Field of Search ..... 439/668, 669, 439/34, 265, 700, 660

[56] References Cited

U.S. PATENT DOCUMENTS 4,322,122 3/1982 Schwartz et al. ..... 439/668
5,261,838 11/1993 Fujie ..... 439/668
5,482,468 1/1996 Bolin ..... 439/668

FOREIGN PATENT DOCUMENTS 5-159839 6/1993 Japan .
5-87856 11/1993 Japan .
6-7176 1/1994 Japan .

*Primary Examiner*—Paula Bradley
*Assistant Examiner*—Tho D. Ta
*Attorney, Agent, or Firm*—McDermott, Will & Emery

[57] ABSTRACT

In order to permit smooth insertion and removal of a connector plug in a plurality of differently sized sockets which are adapted for use with cigarette lighters, the flexible electrically conductive contacts are arranged so that a bent back portion of each constantly engages a pin-like projection which is formed in the housing of the connector whereby during insertion, the U-shaped bent portions defined by the bent back portions and an outwardly curved portions of each of the contacts the contact the wall of the socket in a manner to establish an electrical ground, can be each displaced into a tapered recess located forward of the level of the projection.

5 Claims, 10 Drawing Sheets

CONNECTOR PLUG FOR AUTOMOBILES

TECHNICAL FIELD

The present invention relates to a connector plug for use with a cigarette socket provided in automobiles. More specifically, the present invention relates to a connector plug which can be universally used in the different diameter sockets that are found in automotive vehicles marketed in Japan, the United States, Europe, etc., and which additionally enables the smooth insertion and removal therefrom.

RELATED ART

In recent years, the demand of cellular telephones has been rapidly increased. When using these devices in an automobile, it is often necessary to utilize the electrical power available from the cigarette lighter connector socket. As a result there has been an increased demand for an automotive connector plug which can be inserted/removed into/from a cigarette lighter connector socket and which includes a built-in DC-DC converter.

However, there are a variety of different connector sockets which vary between automotive makers and countries, and as yet no standardized specification has been established. By way of example, connector sockets in Japanese cars and American cars are from 20.9 to 21.1 mm in diameter, while those in European cars are from 22.1 to 22.3 mm in diameter.

Even though there is a variety of different diameter connector sockets, it is desired to provide a single connector which can be use in all of same.

FIGS. 1 and 2 show a conventional connector plug 10 for use in automobiles. This connector plug 10 includes bent plane plate springs of narrow width which form contacts 13. These contacts 13, for example, are arranged to protrude from windows 12 of a housing 11, and are mounted in a manner which enables free movement of the same. Accordingly, in the case of a large diameter connector socket 24 such as shown in FIG. 3(*a*), or in the case of a small diameter connector socket 24 such as shown in FIG. 3(*b*), since there is only a small differences in diameter between the two sockets, the connector plug 10 is such that the contacts 13 can maintain contact with the internal surface of the connector socket 24.

In this respect, as shown in FIGS. 1, 2, 3(*a*) and (*b*), a fuse pipe holder portion 14, receives a fuse tube 15, a cap 17, and a head terminal 18. An electrically conductive coil spring 16 is arranged to bias the head terminal 18 into the fuse tube 15, while lead wires 19, 19 connect a power cord 20, with the spring 16 and one of two contacts 13 which is arranged so that both of its edges make line contact with the socket 24. In the arrangement shown in FIG. 2 the ends of the contacts 13 are received in an insertion hole 22.

As mentioned above, since the conventional contacts 13 are formed by bending plane plate springs, they possess an acute-angled portion along both side edges 23, and a drawback is encountered in that, when the connector plug is inserted into or removed from a connector socket 24, the side edges 23 of the contacts 13 encroach upon the internal surface of the connector socket 24 in the manner shown in FIGS. 3(*a*) and (*b*) whereby the frictional resistance to movement becomes high, and the insertion/removal sensation is accordingly deteriorated.

In particular, as shown in the characteristic diagram shown in FIG. 4, which is plotted in terms of load changes verses the amount of insertion of the contacts 13, when the connector plug is inserted into the small diameter connector socket 24 shown in FIG. 3(*b*), the characteristics depicted in dotted lines are produced. More specifically, while the amount of insertion is still shallow, the load is comparative small and the characteristics a shown in the left-hand part in FIG. 4, are produced and the inserting feeling is smooth. However, as the insertion deepens, the load changes rapidly and increases in the manner depicted by the characteristic b shown in the right-hand part in FIG. 4. Accordingly, in the case of an overly strenuous insertion or removal, there is a fear that one of the contacts 13 may be over-stressed and broken.

To overcome this problem, the present applicant has previously proposed a system to switch the height of the contacts 13 (viz., amount of protrusion from the window 12 of the housing 11) via the movement of a slider 52 depicted in FIG. 5, and thus attain an adaptable connector plug for automotive use.

In FIG. 5, the contact 13 is formed with a straight base 33, a bent contact piece portion 34 expanding unitarily from the base 33, and a "turned-back" or hooked piece 36 which extends back from the tip of this contact piece portion 34, to form an inwardly extending U-shaped configuration. The upper of the two illustrated contacts 13 is used as a ground, while the other is a dummy. A lead wire 19 from the power cord 20 is connected to the base 33 of the grounding contact 13. This arrangement is assembled by engaging both upper and lower contacts 13 and 13 the base 33 in a base holding groove 41 of the housing 11, so that protruding contact piece portions 34 and 34 extend from windows 12, 12, and so that turned-back piece portions 36 and 36 face circuit protective wall portions 50 and 50.

The turned-back piece portion 36 of the contact 13, are formed with 2-stage levels 36*a* and 36*b*. Further, reciprocal sliders 52 are inserted between the turned-back piece portions 36 and the circuit protective wall portions 50. These upper and lower sliders 52 and 52 are linked into a unit and are designed to be displaced by means of a knob portion 54 which protrudes through a window 53 formed through the side of the housing 11.

In this arrangement, when the connector plug 10 is disposed in a large diameter connector socket 24, as shown in FIG. 5, the sliders 52 are slid leftward as seen in the figure, under the control of the knob portion 54. At this time, the sliders 52 passes by the taper portions 55, and thus push and widen the upper and lower contacts 13 and 13, through their interposition between levels 36*a* and the circuit protective wall portion 50. The upper and lower contacts 13 and 13 are thus pushed outward and widened respectively, and the amount of protrusion from the housing 11 of contact piece portions 34 and 34 is increased to match the large diameter of the connector socket 24.

In case the connector plug 10 is disposed in a small diameter connector socket 24, as shown in FIG. 6, the slider 52 is slid rightward as seen in the figure, so that the slider 52 travels rightward in the figure between the turned-back piece portion 36 and the circuit protective wall portion 50. For such a reason, the upper and lower contacts 13 and 13 return to their original positions under their own elasticity, respectively. As a result, the level 36*a* of the turned-back piece portion 36 and the circuit protective wall portion 50 closely juxtapose one another, and the quantity of protrusion from the housing 11 of upper and lower contacts 13 and 13 is reduced to the degree that it matches the small diameter connector socket 24.

The above arrangement however suffers from the problem that it is not only complicated in shape, but the movable slider mechanism (viz., slider 52) causes the configuration to become extremely complicated. That is to say, the contact 13 requires levels 36*a* and 36*b,* and a taper portion 55 in each of the turned-back piece portions 36.

Further, the sliders 52 are such as to require a configuration which simultaneously drives the upper and lower contacts 13 and 13, along with that which permits sliding in of the housing 52 within the housing 11, and to have a knob portion 54 which projects from the slide window 53. In addition to this there are problems that the movable portion, due to its complicated mechanisms is, among other things, apt to be broken during its use.

A first object of the present invention therefore is to obtain a smooth insertion feeling by suppressing changes in load with respect to the amount of insertion of the contacts when inserting the plug into the socket within a specified range as much as possible even though the diameters of the sockets are different.

A second object of the present invention is to obtain smooth insertion and removal of plug by way of a simple configuration, to the degree of being compatible with automotive cigarette lighter connector sockets of different size.

SUMMARY OF THE INVENTION

The present invention, in order to attain the improvement of the inserting feeling according to the first object, resides in a automotive connector plug 10 which has a housing 11 in which plate springs, that can undergo free movement, are installed. These springs form contacts 13 which have a base 33 fixed to the housing 11, unitary contact piece portions 34 to contact/separate the connector socket 24, and a convex spherical portion 35 which has an outside diameter that is roughly the same as the inside diameter of the connector socket 24.

As mentioned above, the spherical portion 35 of each of the contacts 13 is formed by bending the portion to have slightly less than or roughly the same inside diameter as a small diameter connector socket 24. Therefore, in case the large diameter connector socket 24 is used, or in case the connector socket 24 has a small diameter is used, the plug can be inserted and removed smoothly wherein it contacts the inner surface of the connector socket 24 and produces only a small amount of frictional resistance. In addition to this, the insertion sensation is excellent.

The present invention is, in order to obtain the smooth insertion and removal of plug through the use of a simple configuration as per the second object, such as to comprise a automotive connector plug wherein the contacts 13 each consist of a base 33 composed of a metal plate of narrow width having both conductivity and the elasticity, contact piece portions 34 which extend unitarily from this base 33, and turned-back piece portions 36 bent at the tip of each contact piece portion 34 so as to curve inwardly.

The window 12 through which the contacts portions extend is formed in the housing 11, while a circuit protective wall portion 50 is formed inside this window 12. Recessed portions 40 are provided in the circuit protective wall portion to permit a large amount of bending of the tip edge of the contact 13.

With such a configuration, in case the plug is inserted into a large diameter connector socket 24, the contact piece portion 34 of each contact 13 is smoothly inserted and removed as it contacts the internal wall of the connector socket 24. In the case the connector socket 24 is of a large diameter, the turned-back piece portions 36 are forced into the recessed portion 40, but do not contact the circuit protective wall portion 50. This allows a lot of bending to be absorbed. In case the plug is inserted into a small diameter connector socket 24, the tip of the contact piece portion 34 contacts the circuit protective wall portion 50, and further insertion, the tip portion of the contact piece portion 34 is caused to move inwardly until it contacts the recessed portion 40. For this reason, the contact piece portions 34 of the contact 13 pass smoothly along the inner wall of the connector socket 24 similarly as previousle described.

For the present invention, thus, naturally in case the plug 10 is inserted into the socket 24 of large diameter, even in case it is inserted into the socket of small diameter, because of the tip portion of the contact piece portion 34 is turned back till it contacts the recessed portion 40, the contact piece portion 34 of the contact 13 is inserted smoothly contacted to the inner wall of the connector socket 24.

BRIEF DESCRIPTION OF THE DRAWINGS

FIG. 3(*b*) is an enlarged cross-sectional end view depicting the insertion of a conventional automotive connector plug into the small diameter connector socket.

FIG. 10(*b*) is a B—B line cross-sectional end view of FIG. 10(*a*).

FIG. 11(*b*) is a C—C line cross-sectional end view of FIG. 11 (*a*).

FIG. 12(*b*) is a D—D line cross-sectional end view of FIG. 12(*a*).

DETAILED DESCRIPTION OF THE PREFERRED EMBODIMENTS

Figure 7:
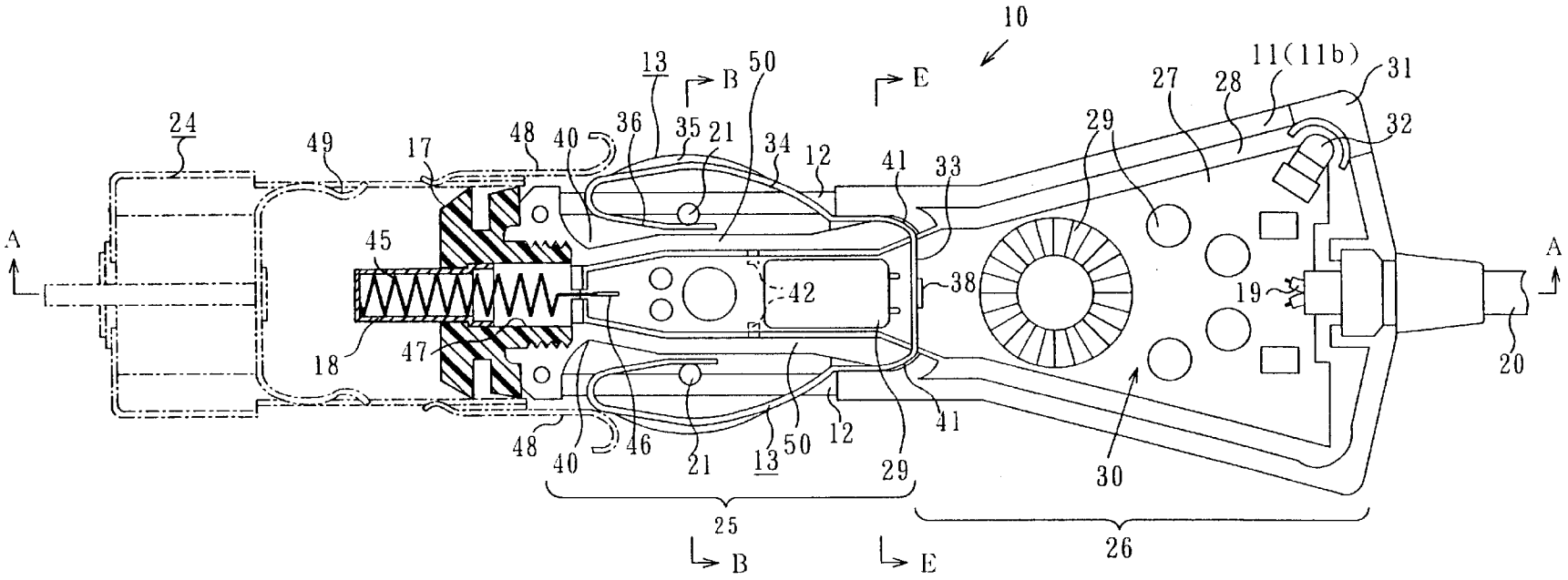
FIG. 7 is a front view of showing embodiment of automotive connector plug according to the present invention wherein the upper housing has been omitted.
Figure 8:
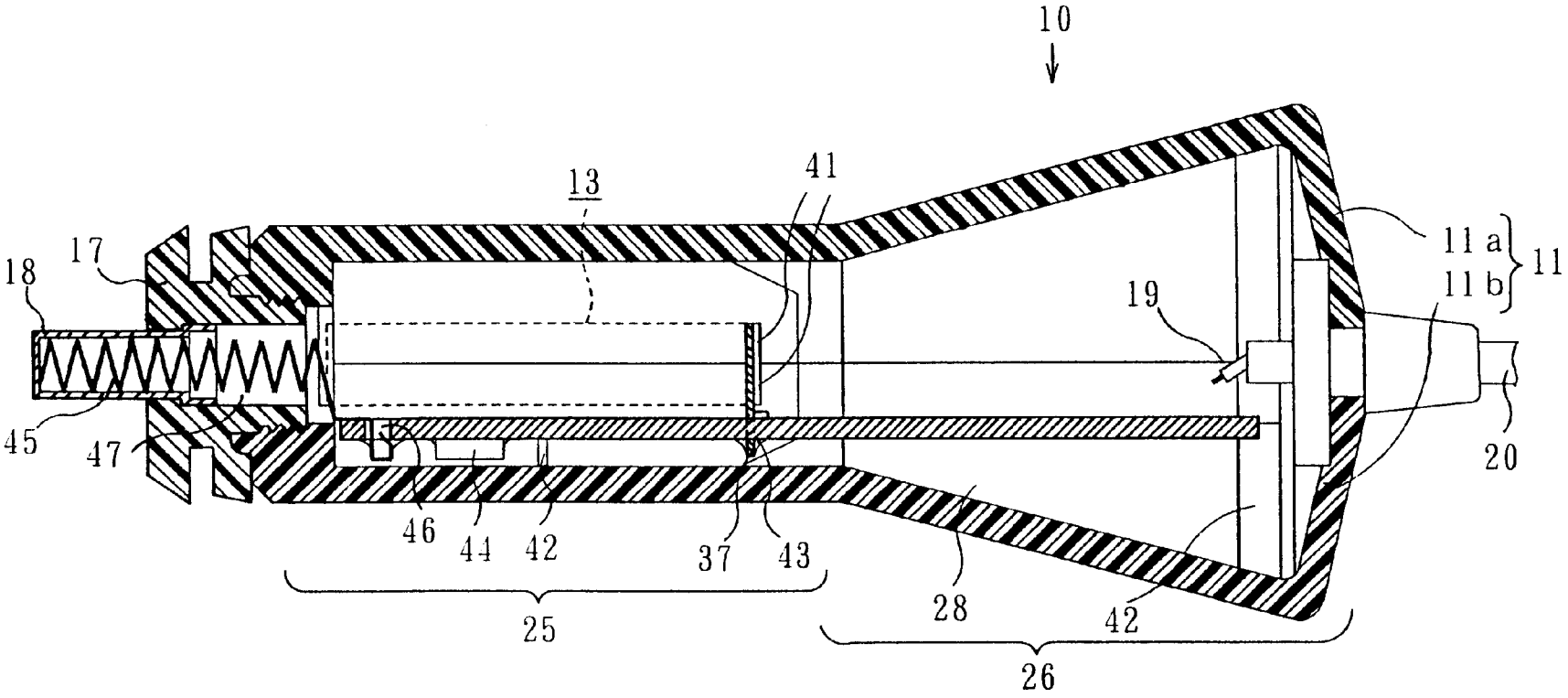
FIG. 8 is an A—A line cross-sectional view of FIG. 7.
Figure 11B:
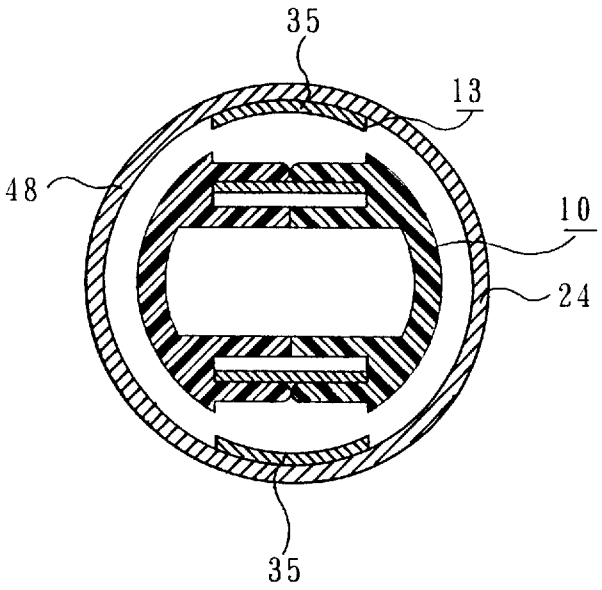
FIG. 11(*a*) is an enlarged front view showing the insertion of an automotive connector plug according to the present invention, into a large diameter connector socket.
Figure 11A:
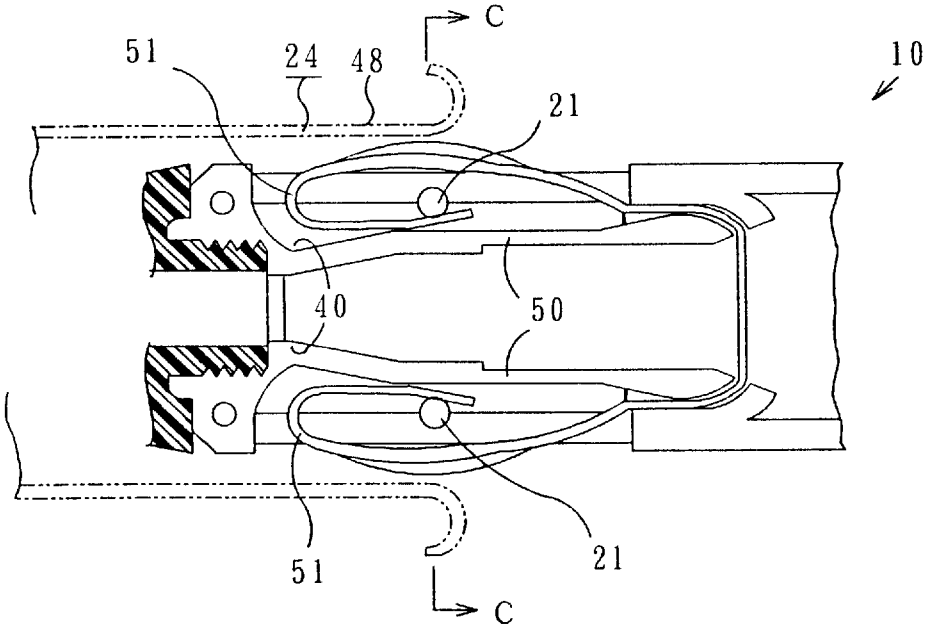

FIGS. 7 and 8, 11 show a housing composed of an upper housing 11*a* and a lower housing 11*b*. The combination of these housings 11*a* and 11*b,* is such that the front half (lefthand half in the figure) becomes the insertion portion 25 which is inserted into the connector socket 24, while the back half 26 stores the DC-DC converter 30 mainly composed of circuit elements 29.

The shape of this rear portion 26 is conical in such a manner that the mounting side of power cord 20 can have a gradually increasing diameter. However, the invention is not limited to this particular shape.

Both of the upper and lower housings 11*a,* 11*b* are formed with a window 12 through which a contact 13 can protrude. Inside each of these windows 12, is a circuit protective wall portion 50 defined by a body which is integral (unitary) with the housing 11.

A hollow portion 28 formed in the housings 11*a* and 11*b,* stores a printed circuit board 27 which is fixedly disposed on a board 42. This printed circuit board 27, includes circuit elements 29 such as transistors, capacitors, resistors, choke coils, microcomputers, etc. which are arranged to form a DC-DC converter 30.

The printed circuit board 27, in addition to the circuit elements 29, has a contact 13 coil spring 45, power cord 20, power lamp 32, etc., connected thereto to form single body.

Figure 9:
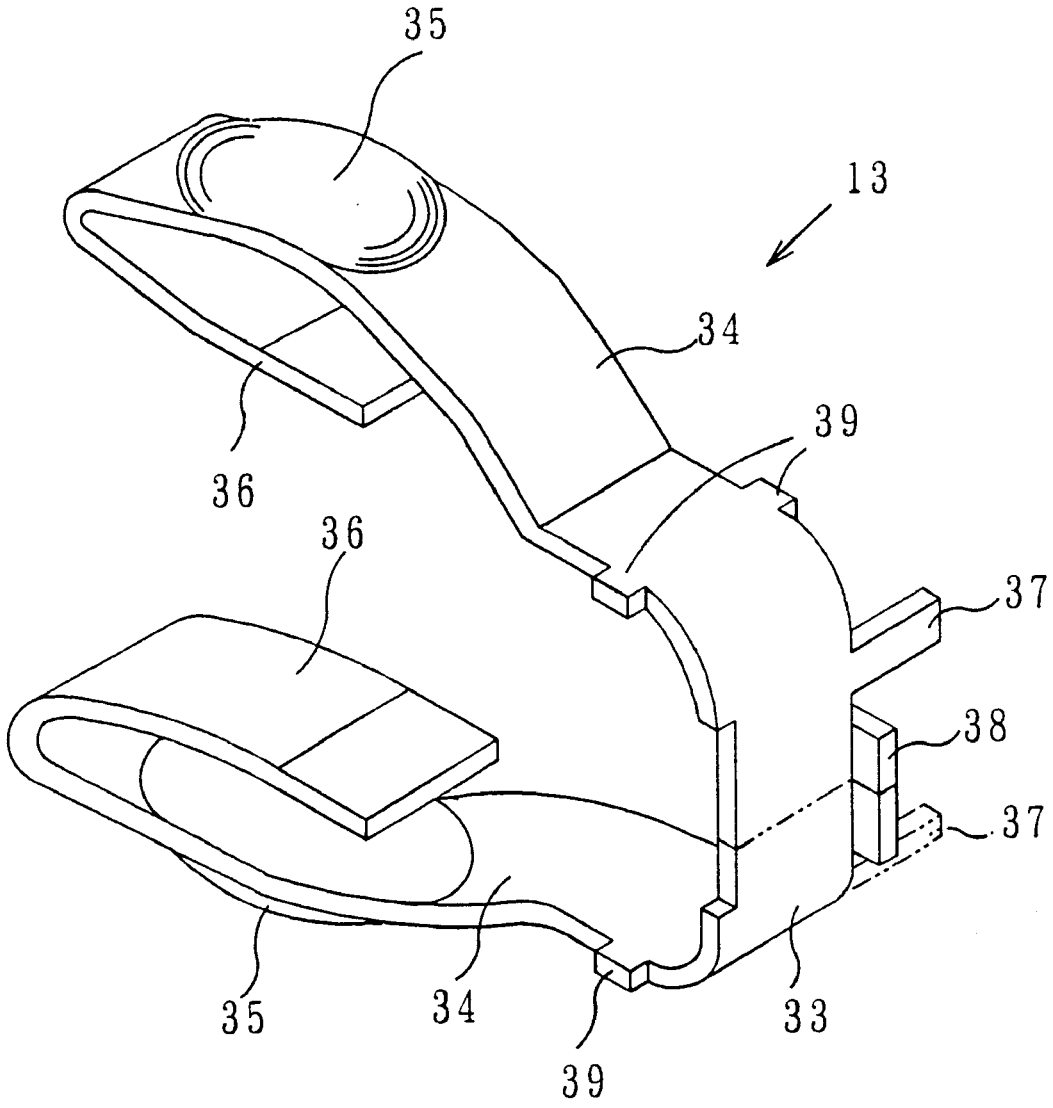
FIG. 9 is a perspective view of a contact used in accordance with the present invention.

The contacts 13, as shown in FIG. 9, have been formed by bending a narrow strip of electrically conductive and elastic metal into the shape of the letter "U" to define a base 33 and contact portions 34 which extend from both sides of this base 33.

The base 33 includes a fixed piece portion 37, a horizontal holding piece portion 38 and a positioning projection portion 39. In the contact portions 34 and 34 are externally convex spherical portions 35 and 35. The turned-back piece portions 36 and 36 are formed by bending the tips of the contact piece portions 34 and 34 inwardly. These spherical portions 35 are formed to each have a diameter which is roughly the same as the inside diameter of the smaller of the connector sockets to which the invention is applicable.

The contact 13 thus formed, has the fixed piece portion 37 inserted into a through hole in a center portion of the printed circuit board 27, in a manner which intimately contacts the horizontal holding piece portion 38 against an upper face of the printed circuit board 27. This connects the tip portion of the fixed piece portion 37 which protrudes from the back of the printed circuit board 27, to the circuit board 27 and to the circuit pattern thereon.

The end of the conductive coil spring 45 inserted into the through hole 46 at the tip edge of the printed circuit board 27, and is fixedly connected by solder 43 to the back thereof. The spring 45 is also connected to a chip type fuse 44 by means of the circuit pattern.

A corner of the rear edge of the printed circuit board 27 is used to support a power lamp 32. This lamp is fixed and electrically connected by soldering 43. This power lamp 32 located behind a transparent light plate portion 31 of the housing 11.

Between the windows 12 in the housing 11 and the circuit protective wall portion 50, are integral projections 21. Initial pressure is established by hooking a portion of each of the turned-back piece portions 36 onto these projections 21.

In addition to this, at the leading end of the circuit protective wall portion 50, is a contact escape recessed portion 40 which is designed to permit a large amount of bending of the tip portion of the contact 13 during insertion of the plug 10 into a socket 24 of small diameter.

At the tip portion of the leading edge 25 of the housing 11 is a cap 17 which is attached thereto by a screw thread. The head terminal 18 is reciprocally disposed through a hole 47 in this cap 17 and is constantly biased in the forward direction by the coil spring 45. The diameter of the external circumference of this cap 17 is formed in such a manner that it can be inserted into a bimetal 49 of even the smallest type of connector socket 24.

The printed circuit board 27 has, in addition the contact 13, coil spring 45, etc., circuit elements 29 of the DC-DC converter 30 adhered to in a manner to be housed in the lower housing 11*b*.

The contact 13 which is fixed to the printed circuit board 27, is such that when housed in the lower housing 11*b,* the base 33 is engaged in a base holding groove 41 of the housing 11 in a manner that the while contact piece portion 34 is permitted to extend convexly outward it is subjected to a slight inward bias. This establishes an initial pressure which causes the turned-back piece portion 36 to be positioned between the projection 21 and the circuit protective wall portion 50 while being engaged with the projection 21. Accordingly, initial pressure is applied at 2 places—viz., the base holding groove 41 and the projection 21.

At this time, the initial pressure to the contact 13 is fully established. The deflection quantity of the contact 13 when plugging and unplugging the connector plug 10 to the socket 24 is reduced, whereby the elasticity lowering is maximally suppressed, and therefore the initial pressure can be maintained for a long period of time.

Since the part of the contact piece portion 34 which extends out in the external direction is pegged by the projection 21, the bending portion between the contact piece portion 34 and the turned-back piece portion 36 is always positioned in the window 12. Thus, even it is inserted into the socket 24 of small diameter, in particular, it is such that the plug 10 can be smoothly inserted into the socket 24.

After the printed circuit board 27 is fixed on the lower housing 11*b,* the upper housing 11*a* is fixed in place by screws. After upper and lower housings 11*a* and 11*b* are secured together, the cap 17 inserting the head terminal 18 is screwed on at the tip of the inserting edge 25. At this time, the bias of the coil spring 45, which is inserted into the head terminal 18, causes the head terminal 18 to be constantly protruded from the cap 17.

Figure 10B:
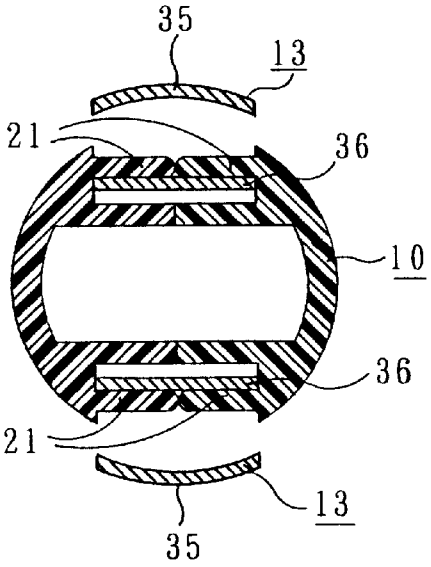
FIG. 10(*a*) is an enlarged front view of important portions of the arrangement shown in FIG. 7.
Figure 10A:
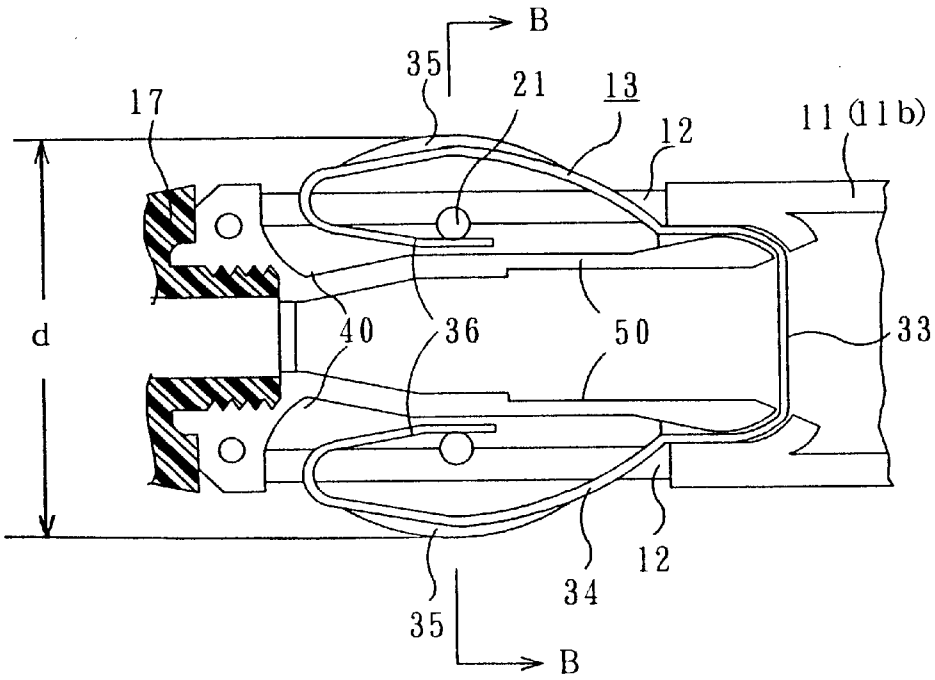

The contact 13 of the connector plug 10 thus assembled, as shown in FIG. 10(*a*), is set in such a manner that the interval d of each spherical portion 35 is a little larger than the inside diameter of the connector socket 24 of the largest interval d of the spherical portion.

With the above arrangement, as shown in FIGS. 11(*a*) and (*b*), in the case the connector plug 10 according to this invention is inserted into a large diameter connector socket 24, since the extent of curvature of each spherical portion 35 is either the same or a little smaller than the inside diameter of the small diameter connector socket 24, it is inserted and removed while smoothly contacting the inner wall of the connector socket 24. Further, when the connector socket 24 has a large diameter, each turned-back piece portion 36 is in contact with the circuit protective wall portion 50, but is not forced into a recessed portion 40.

Figure 12B:
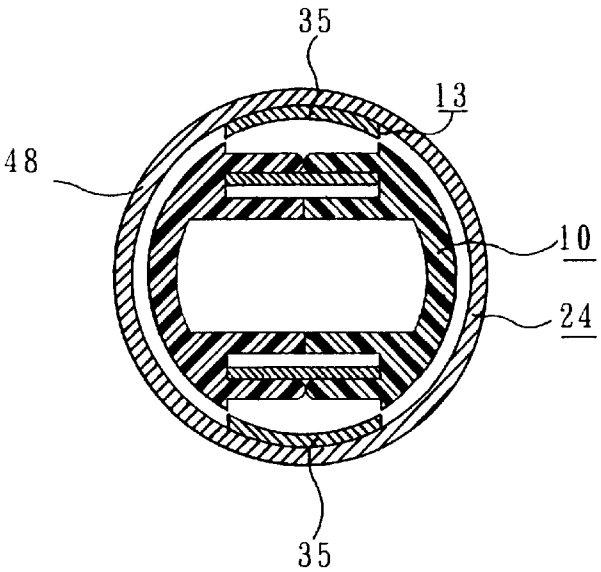
FIG. 12(*a*) is an enlarged front view showing the insertion of the automotive connector plug according to the present invention, into a small diameter connector socket.
Figure 12A:
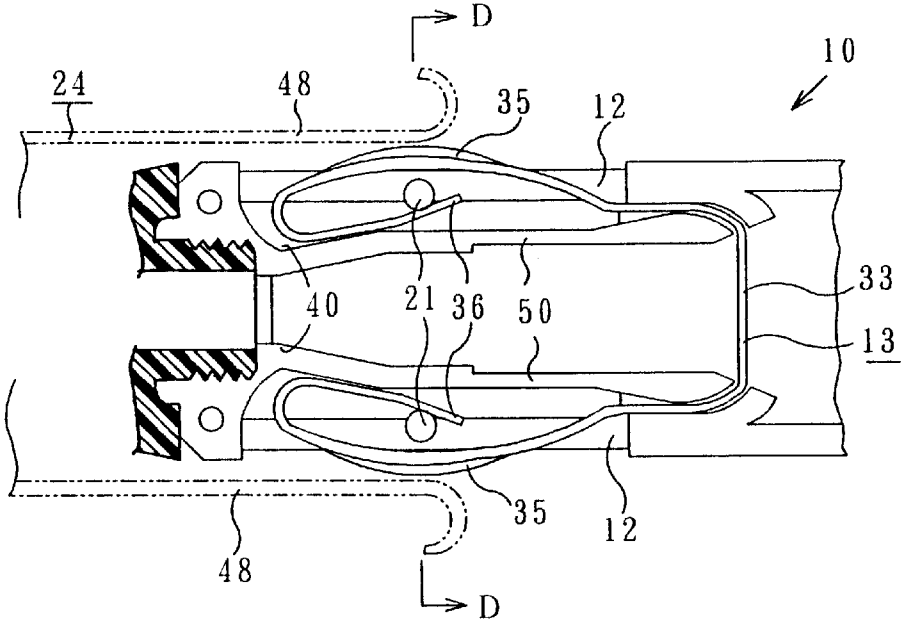

FIGS. 12(*a*) and (*b*) show the situation in which the connector plug 10 according to the present invention is inserted into the small diameter connector socket 24. In this case, since the curvature of the each spherical portion 35 is a little smaller than the inside diameter of the small diameter connector socket 24 or approximately same, it is inserted and removed while smoothly contacting the inner wall of the connector socket 24. Further, as the connector socket 24 is of small diameter, the tip of each contact piece portion 34 contacts the circuit protective wall portion 50, and the tip portion of each contact piece portion 34 is deflected in such a manner it is forced down and into recessed portion 40.

In the above embodiment, the contact 13 was bent roughly in form of the letter "U" so as to have a base portion 33 and two contact piece portions 34 and 34 which extend from either side of this base 33. However, the present invention is not to such a structure, and it is within the scope of the invention to use a two-piece construction and fix the individual pieces to the printed circuit board 27.

Further, in the case two contact piece portions 34 are made separate portions, it is possible to connect one contact piece portion 34 with the lead wire 19, to ground one side of the printed circuit board 27, and to use the other contact piece portion 34 as a dummy similarly to the conventional arrangements.

Since this invention uses convex spherical portions 35 on the contact piece portions 34 of the contact 13, smoothly contact with small friction resistance with the inner wall of the connector socket 24 enables an excellent inserting feeling to be provided.

Figure 1:
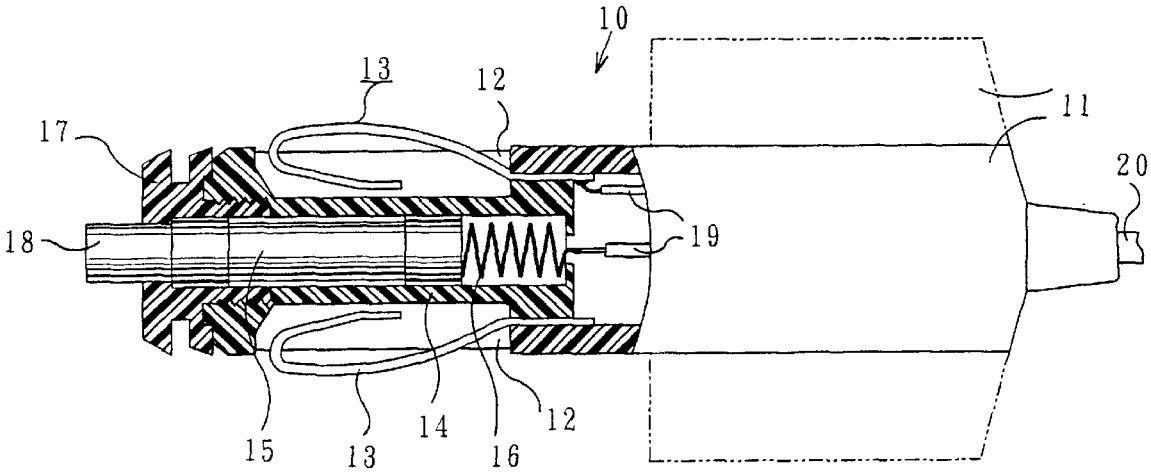
Fig. 1 (PRIOR ART)
FIG. 1 is a partially sectioned front elevation of conventional automotive connector plug.
Figure 2:
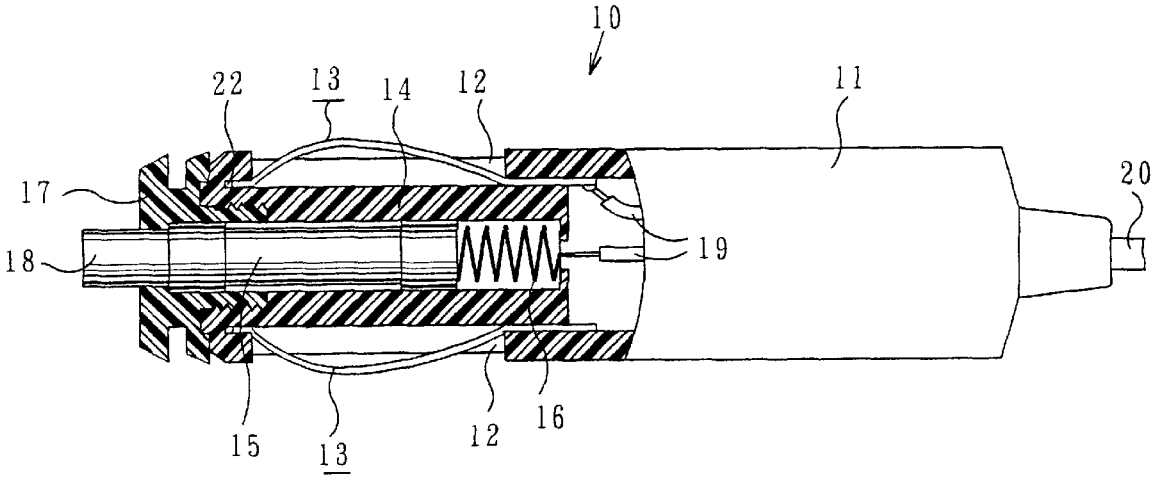
Fig. 2 (PRIOR ART)
FIG. 2 is a partially sectioned front elevation of another conventional plug for automobiles.
Figure 3A:
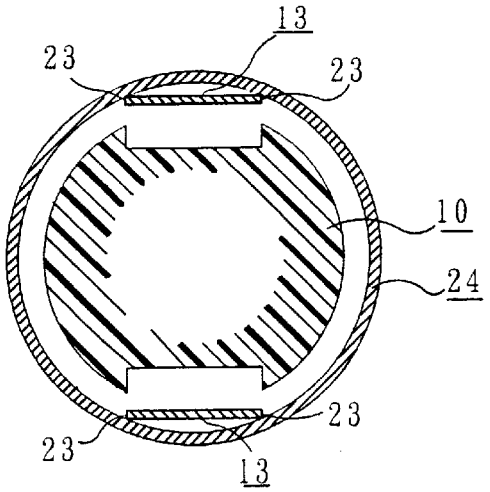
Fig. 3(a) (PRIOR ART)
FIG. 3(*a*) is an enlarged cross-sectional end view showing the insertion of a conventional automotive connector plug into a large diameter connector socket.
Figure 3B:
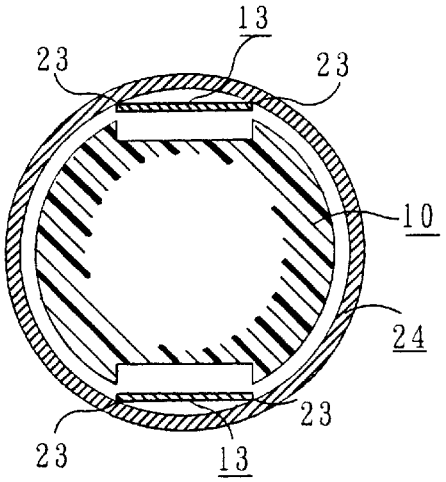
Fig. 3(b) (PRIOR ART)
Figure 4:
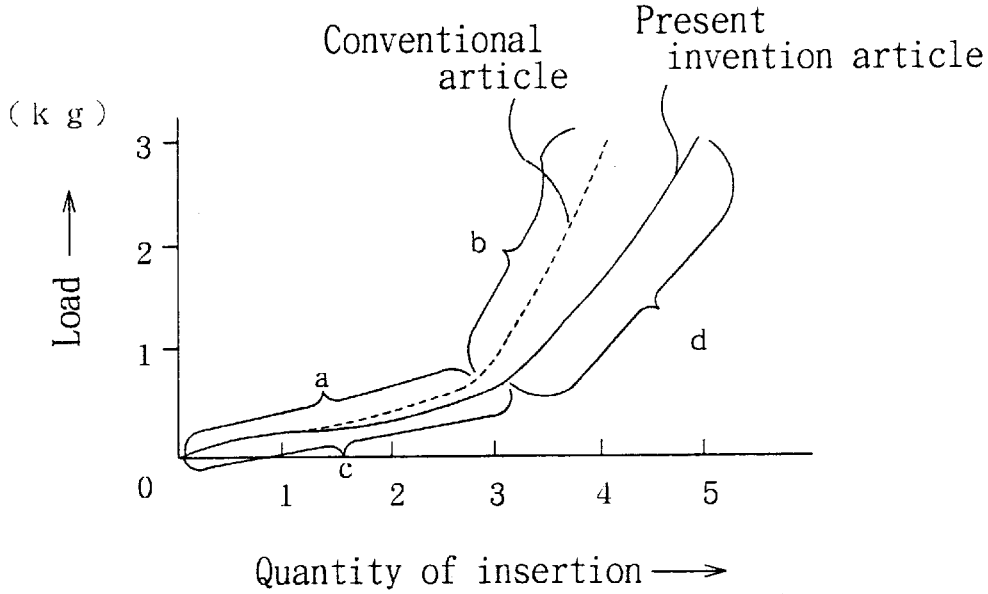
Fig. 4 (PRIOR ART)
FIG. 4 is a chart plotted in terms of changes in load verses the displacement of the automotive connector plug according to the present invention along with that for a conventional automotive connector plug.
Figure 5:
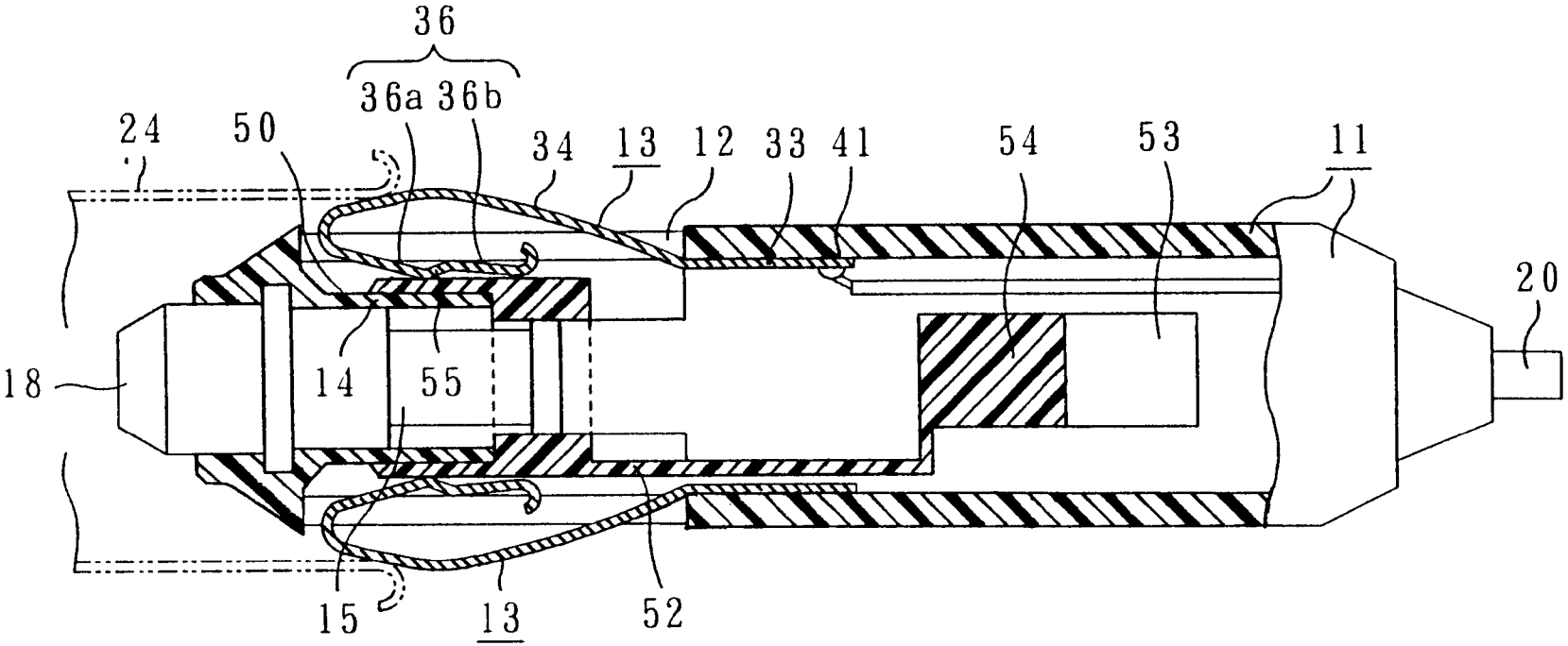
Fig. 5 (PRIOR ART)
FIG. 5 is a partially sectioned front view showing the applicant's previously proposed automotive connector plug showing the case wherein it is disposed in a connector socket of large diameter.
Figure 6:
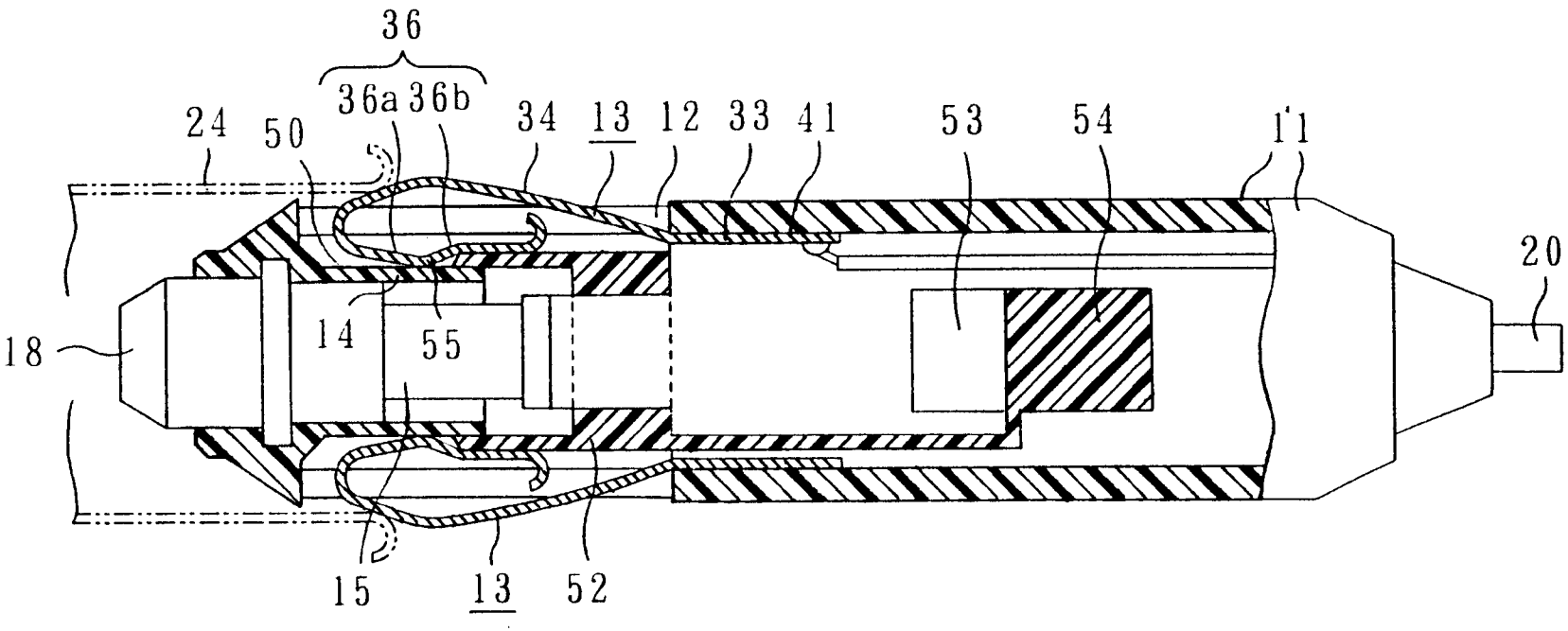
Fig. 6 (PRIOR ART)
FIG. 6 shows the automotive connector plug shown in FIG. 5 disposed in a small diameter connector socket.

In addition, the change in load verses the quantity of insertion of the contact 13 in accordance with the present invention is, as shown with continuous lines in FIG. 4, such that while the insertion position is still shallow, it is smoothly inserted as indicated by the characteristic c in the left-hand portion of the trace. Even when the insertion position is deep, as shown by the characteristic d in the right-hand part in FIG. 4, insertion is fairly smooth in comparison with the conventional arrangement, the friction resistance remains low, the inserting feeling is good, and there is no breakages caused by the insertion or the removal.

The present invention provides the window 12 in the housing 11, forms the circuit protective wall portion 50 inside this window 12, and forms the contact escape recessed portion 40 to absorb a large bending of the tip edge of contact 13 in this circuit protective wall portion 50. Naturally, in case the plug is inserted into a socket of large diameter, or in the case it is inserted into a socket 24 of small diameter, as each contact piece portion 34 is bent in such a manner the tip portion lowers into recessed portion 40, the contact piece portion 34 of the contact 13 is smoothly contacted with the inner wall of the connector socket 24, during insertion and removal.

Since the strength which tends to widen the contact piece portions 34 in the external direction is reduced by the projection 21, the bending part of the tip between the contact piece portion 34 and the turned-back piece portion 36 is always located inside the window 12, even when inserting it into the socket 24 of small diameter, in particular, the plug 10 is smoothly inserted into the socket 24.

When connecting the contact 13 to the printed circuit board 27, as the base 33 is engaged in the base holding groove 41 of the housing 11, and the turned-back piece portion 36 is engaged between the projection 21 and the circuit protective wall portion 50 pushing the contact piece portion 34, establishes initial pressure in two places, the initial pressure to the contact 13 is fully given, as well the deflection quantity of the contact 13 when plugging and unplugging from the socket 24 is reduced, the elasticity lowering effect is suppressed to the maximum, and therefore the initial pressure can be maintained for a long period of time.

Industrial Utilization Possibility

The present invention relates to a connector plug which can be universally used in different diameter cigarette lighter connector sockets in automobiles throughout the world, including those use in Japan, the United States, Europe, etc. Not does the invention provide a connector plug for cigarette lighter sockets, but also provides a connector plug incorporating a DC-DC converter in the same unit, thus enabling a power supply for a cellular telephone from the cigarette lighter connector socket.

What is claimed is:

1. A connector plug for an automobile comprising:

a housing having a front end and a rear end, the front end being adapted for insertion into a cigarette lighter socket;

a window formed in the housing;

an electrically conductive contact disposed in the housing, the contact having:

a base portion which is set in a supporting structure within the housing, a flexible outwardly curved portion which extends from the base portion toward the front of the connector plug, which is integral with the base portion, and which has a portion which is adapted to project out through the window, and a bent back portion which is formed at a free end of the outwardly curved portion to form a U-shaped bend having a tip which is distal from a terminal end of bent back portion;

a protective wall formed in the housing;

an inwardly tapered recess portion formed in the protective wall portion into which the tip of the U-shaped bend can be displaced thereinto during inward flexure of the outwardly curved portion in through the window; and a projection which is located rearwardly of the inwardly tapered recess and which constantly engages the bent back portion proximate the terminal end thereof even when the tip of the U-shaped bend is displaced into the inwardly tapered recess and a portion of the bent back portion contacts a surface of the inwardly tapered recess.

2. A connector plug as set forth in claim 1, wherein the projection applies pressure to the bent back portion to restrains the outward movement of the outwardly curved portion of the contact through the window.

3. A connector plug as set forth in claim 1, wherein the supporting structure in which the base of the contact is set, applies pressure to a portion of the outwardly curved portion which restrains the outward movement of the outwardly curved portion through the window.

4. A connector plug as set forth in claim 1, wherein the base portion of the contact is formed with at least one projection which can engage a circuit board which forms part of a current converter circuit disposed in the rear end of the housing.

5. A connector plug as set forth in claim 1 further comprising a spherical convex engagement portion formed in a portion of the outwardly curved portion.

* * * * *